United States Patent [19]

Loebner

[11] 4,329,739

[45] May 11, 1982

[54] LIGHTED DISCO DANCE FLOOR

[76] Inventor: William Loebner, 27 Crane St., Newark, N.J. 07104

[21] Appl. No.: 21,191

[22] Filed: Mar. 16, 1979

[51] Int. Cl.[3] ..... F21S 1/14; G09F 19/00

[52] U.S. Cl. ..... 362/153; 40/406

[58] Field of Search ..... 52/6, 7, 588; 362/32, 362/153, 806; 352/85; 272/2, 3, 8 R, 8 P, 9, 10, 15, 18; 35/29 C; 40/406, 407, 409, 442, 444, 902; 62/264

[56] References Cited

U.S. PATENT DOCUMENTS 2,457,619 12/1948 Yocum ..... 362/153 X 3,611,655 11/1969 Loebner ..... 52/588

3,755,663 8/1973 George, Jr. ..... 362/806 X

FOREIGN PATENT DOCUMENTS

24038of of 1894 United Kingdom ..... 362/153

*Primary Examiner*—L. T. Hix

*Assistant Examiner*—Thomas H. Tarcza

*Attorney, Agent, or Firm*—Robert E. Burns; Emmanuel J. Lobato; Bruce L. Adams

[57] ABSTRACT

A portable lighted disco dance floor for converting an area into a dance floor and having lights internally thereof for lighting the dance floor.

2 Claims, 5 Drawing Figures

LIGHTED DISCO DANCE FLOOR

BACKGROUND OF THE INVENTION

This invention relates generally to portable floors and more particularly to an assembly of a roll-up and portable floor which can be used to convert an area into a dancing area.

Frequently a floor surface is not suitable for the purpose desired. Thus for example a floor space may not be suitable for dancing because it is carpeted or because it is susceptible to scuffing. Similarly when camping, the floor area of a tent which normally would be the bare ground is not found desirable. Many other occasions may arise where desired to create a new floor surface thus the need arises for portable floors and such floors are well known as illustrated in U.S. Pat. No. 3,611,655.

SUMMARY OF THE INVENTION

It is an object of the present invention to provide a portable, roll-up floor which may, if desired, be assembled in different sizes and may be rolled into a compact configuration for storage and transportation. The floor is provided with internal lighting for use as a disco dance floor.

Another object of the present invention is to provide a floor and gas generator for simulating the formation of a cloud or the like over the dance floor area.

BRIEF DESCRIPTION OF THE DRAWINGS

The invention will be described by reference to the drawings in which.

DESCRIPTION OF PREFERRED EMBODIMENTS OF THE INVENTION

The floor construction according to the present invention is similar to the floor disclosed in my U.S. Pat. No. 3,611,655.

Figure 1:
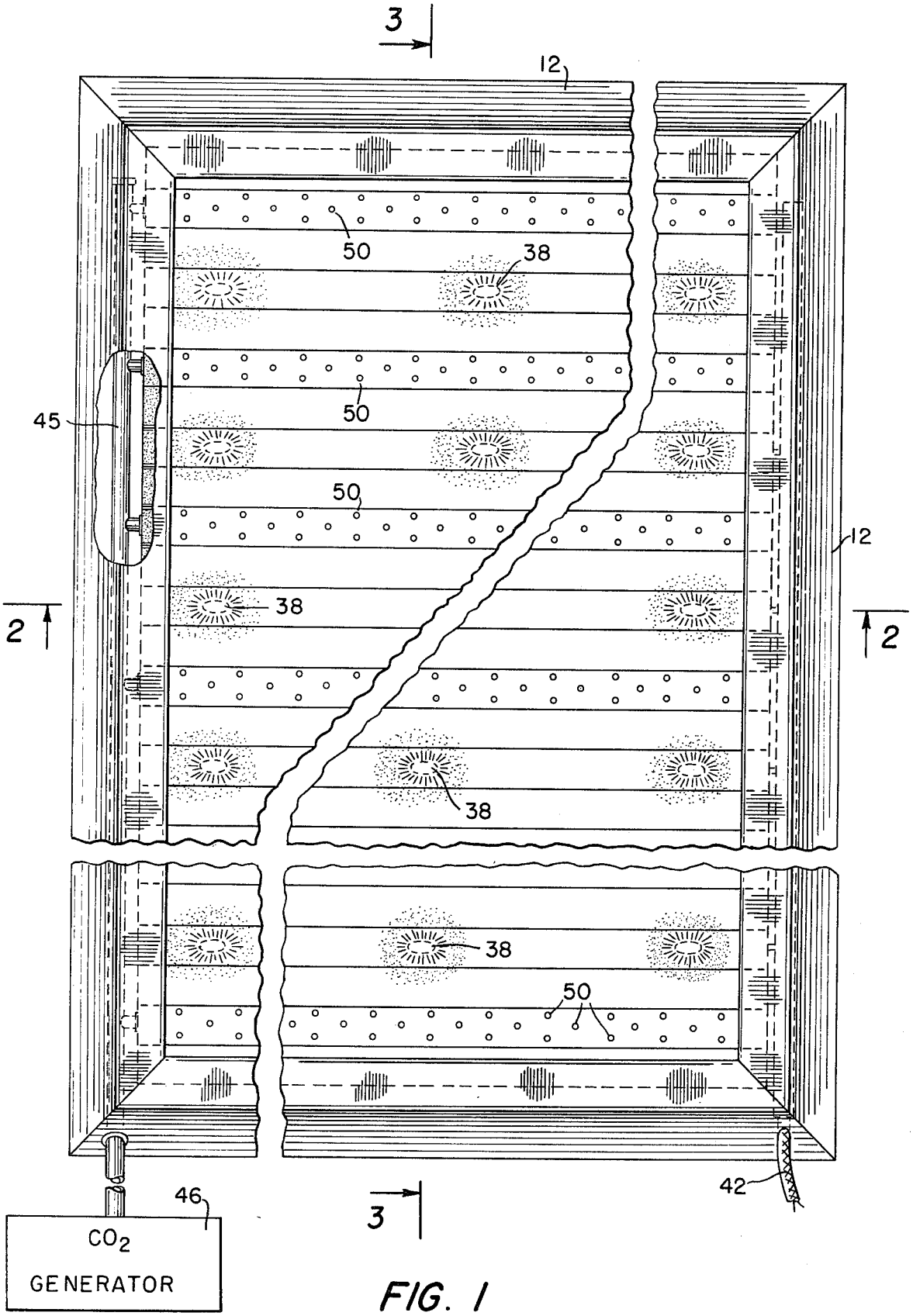
FIG. 1 is a plan view of the overall floor, according to the invention.
Figure 2:
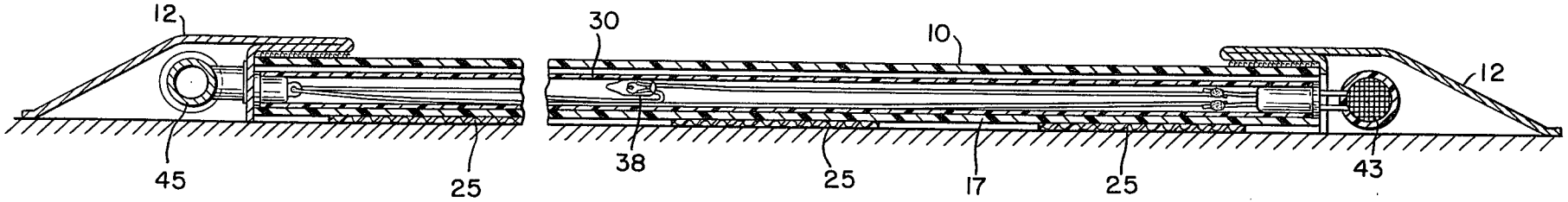
FIG. 2 is a cross section view taken along section line 2—2 of FIG. 1.
Figure 3:
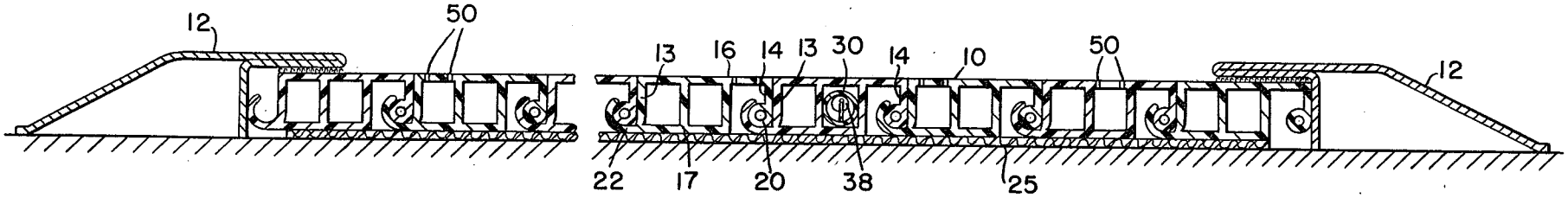
FIG. 3 is a cross section view taken along section line 3—3 of FIG. 1.

FIG. 3 illustrates the manner in which the slats 10 are joined together at their longitudinal edges. The slats 10 are essentially rectangular in cross-section, each having side walls 13 and 14, top wall 16 and bottom wall 17. Side wall 13 has a tongue extension 20 which mates with the curvature of side wall 14, which curvature defines a groove 22 along the length of the slat. In cross-section, each juncture of the slats thus defined resembles a ball and socket joint and in fact, functions in this manner. A ball and socket joint is provided between each pair of next adjacent slats.

The ball-and-groove joint allows the slats 10 to be rolled when assembled into a portable floor. Moreover, the joint is constructed so that the assembly of the slats in a floor is by positioning the ball of a slat over the groove of another slat to which it is to be assembled and snapping them together. There is no need of sliding the slats longitudinally relative to each other, for assembly and disassembly, as in the other known joints in assembling the floor.

The individual slats are made of a suitable plastic such as PVC and are made of a suitable color. A flexible fabric sheet may be provided on the assembled slats bonded to the lower walls thereof to hold the assembly together. This fabric is readily cut with a sharp edge from the underside of the slats for separating a given member of slats from a roll, when selecting a given width of flooring from a number of assembled slats. The fabric in no way impedes rolling up the portable flooring.

Figure 4:
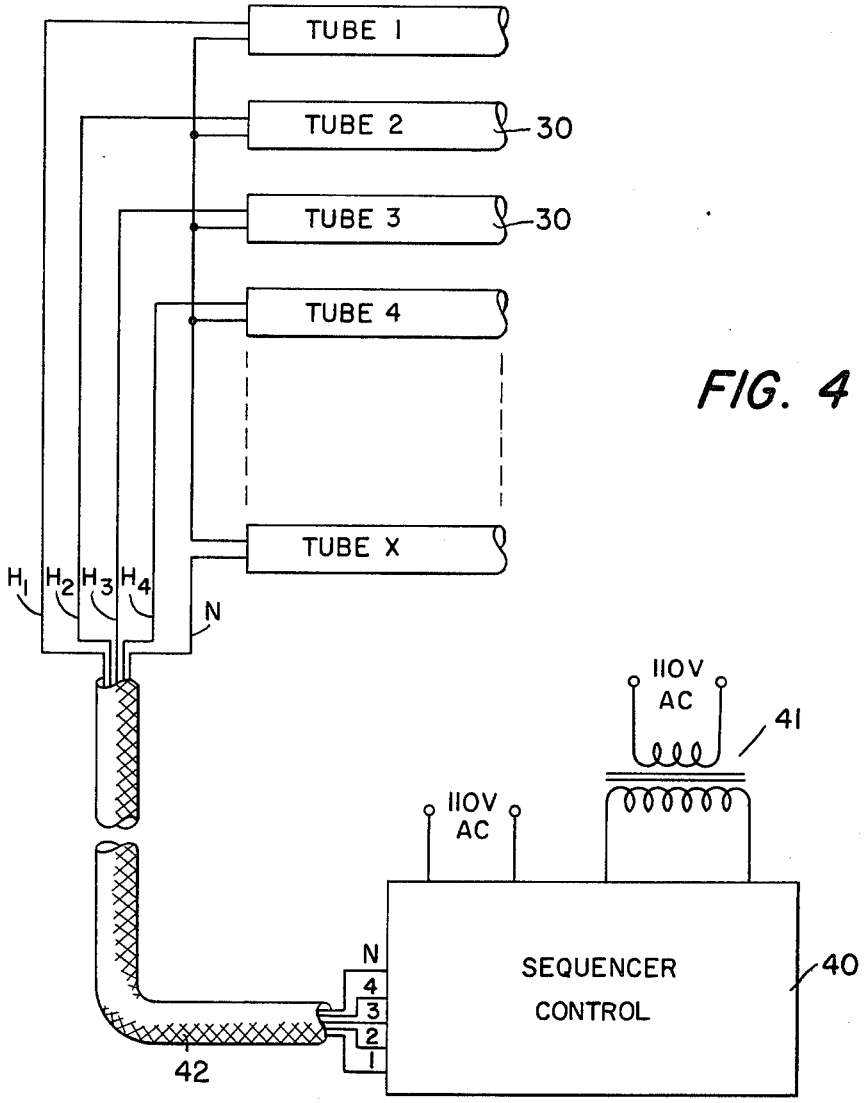
FIG. 4 is an overall circuit diagram according to the invention and FIG. 5 is a circuit diagram illustrating the circuitry in detail illustrated in FIG. 4.
Figure 5:
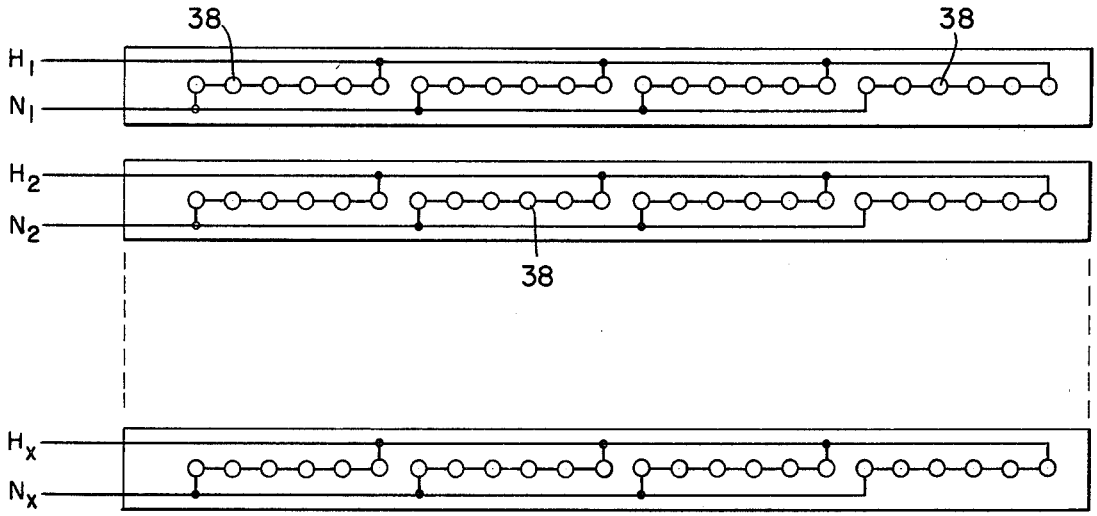

Within the floor slats the tubes 30 designated 1-X as illustrated in FIG. 4 are provided with internal bulbs 38 as illustrated in FIG. 5. These bulbs are grouped to provide for controlling sequencing thereby by a sequencer 40 as illustrated in FIG. 4. The circuitry, illustrated in FIG. 4, provides for the usual 110 volt alternating current to a usable value through a transformer 41 which is connected to the sequence control 40 as illustrated diagrammatically with line connection 1-N inclusive which are connected to the lines $H_1$-H inclusive to provide current to the grouped light bulbs. The connections are made through a cable 42 disposed in a hollow border strip 12.

Those skilled in the art will recognize that the sequence control can be arranged to have chasers 43 in the circuitry so that the lights can be arranged to follow an "on" and "off" condition that will result in a sequence of "on and off" conditions that will be pleasing to the viewer.

The floor is likewise provided with an apparatus for simulating the formation of a "cloud" over the area of the dance floor. Thus the outer or border 12 is hollow and is provided with a manifold 45 with tubes connected to a carbon dioxide generator 46. The generator can produce carbon dioxide which is released and is introduced into the corresponding slats of the dance floor with which the manifold is connected. Perforations 50 are provided in some of the slats in communication with the manifold 45 to allow the carbon dioxide to escape therethrough the simulate the formation of a cloud on the dance floor area.

Those skilled in the art will understand that the slats can be made of different colors and that the slats can define areas which are pervious to light and others which are not. The bulbs and slats can be made such that desired colors are used to effect different color effects with the lights. Moreover, the bulb pattern arrangements can be of different patterns such as circular, starpatterns, etc.

I claim:

1. A portable, roll-up dance floor comprising, a set of elongated hollow slats having a generally rectangular cross section disposed assembled in lengthwise juxtaposition, each slat comprising a top wall and side walls, each slat having means for assemblying the slats juxtapositioned lengthwise for assembly and disassembly thereof without moving the slats relative to each other axially, means internally of at least some of the hollow slats connected in circuit for lighting at least an area of the dance floor, the slats in said area having said top walls thereof pervious to light to allow said area of the dance floor to be lighted, said means comprising internally of each of at least some said hollow slats a tube pervious to light within the corresponding slat and extending longitudinally therein, electric lamp bulbs within each said tube spaced longitudinally therein, and said electric lamp bulbs being arranged in a pattern within said area of said dance floor.

2. A portable, roll-up dance floor according to claim 1, in which at least some of said slats comprise openings on the top wall thereof spaced longitudinally of the corresponding slat, and means to supply carbon dioxide into said slats having openings to simulate formation of a cloud over the dance floor.

* * * * *